US008781076B2

(12) United States Patent
Kuroda et al.

(10) Patent No.: US 8,781,076 B2
(45) Date of Patent: Jul. 15, 2014

(54) PHASE CONTROLLER

(75) Inventors: Hiroto Kuroda, Saitama (JP); Motoyoshi Baba, Saitama (JP); Shin Yoneya, Saitama (JP)

(73) Assignee: Saitama Medical University, Saitama (JP)

( * ) Notice: Subject to any disclaimer, the term of this patent is extended or adjusted under 35 U.S.C. 154(b) by 190 days.

(21) Appl. No.: 13/520,593

(22) PCT Filed: Dec. 28, 2010

(86) PCT No.: PCT/JP2010/073708

§ 371 (c)(1),
(2), (4) Date: Jul. 5, 2012

(87) PCT Pub. No.: WO2011/083727

PCT Pub. Date: Jul. 14, 2011

(65) Prior Publication Data

US 2012/0281816 A1 Nov. 8, 2012

(30) Foreign Application Priority Data

Jan. 7, 2010 (JP) ..... 2010-002301

(51) Int. Cl.
*G21K 1/16* (2006.01)
*G21K 1/06* (2006.01)

(52) U.S. Cl.
CPC ..... *G21K 1/06* (2013.01)
USPC ..... 378/145

(58) Field of Classification Search
CPC ..... G21K 1/06; G21K 1/04; A61B 6/0306; A61B 6/06
USPC ..... 378/145, 119, 123, 136–138
See application file for complete search history.

(56) References Cited

U.S. PATENT DOCUMENTS

2007/0086572 A1* 4/2007 Dotten et al. ..... 378/122

FOREIGN PATENT DOCUMENTS

JP 03-102300 A 4/1991
JP 07-288200 A 10/1995
JP 09-219564 A 8/1997

OTHER PUBLICATIONS

Shidara et al., "Ultrahigh vacuum magnetic field modulation apparatus for magnetic-circular-dichroism studies in the vacuum ultraviolet region", Rev. Sci. Instrum., Jan. 18, 1992, vol. 63, No. 1, pp. 1501-1504.
Imazono et al., "Design of an Apparatus for Polarization Measurement in Soft X-Ray Region", Spectrochimica Acta Part B, 2010, vol. 65, No. 2, pp. 147-151.

* cited by examiner

*Primary Examiner* — Irakli Kiknadze
(74) *Attorney, Agent, or Firm* — Novak Druce Connolly Bove + Quigg LLP

(57) ABSTRACT

A reflection surface 12 constituted by a transition metal having a core level absorption edge in the vicinity of a wavelength of a soft X-ray is formed on an inside of a vacuum vessel 14, and furthermore, there is provided a permanent magnet 13 for generating a magnetic field in a perpendicular direction to a longitudinal direction of the vacuum vessel 14 in a position of the reflection surface 12 by which the soft X-ray is to be reflected, and the soft X-ray to be linearly polarized light incident on the vacuum vessel 14 is reflected at plural times over the reflection surface 12 in a position where the magnetic field is applied in such a manner that magnetic scattering is increased by a resonant effect of a magnetic circular dichroism when the soft X-ray is reflected by the reflection surface 12. Thus, a great difference in a refractive index is made between circularly polarized counterclockwise light and circularly polarized clockwise light which constitute the linearly polarized light, and a phase difference between the circularly polarized counterclockwise light and the circularly polarized clockwise light is obtained at a time. Consequently, it is possible to reversibly convert the soft X-ray from the linearly polarized light into the circularly polarized light or from the circularly polarized light into the linearly polarized light by a reflection to be carried out at only several times.

4 Claims, 2 Drawing Sheets

PHASE CONTROLLER

CROSS REFERENCE TO RELATED APPLICATIONS

This application is a National Phase filing under 35 U.S.C. §371 of PCT/JP2010/073708 filed on Dec. 28, 2010; and this application claims priority to Application No. 2010-002301 filed in Japan on Jan. 7, 2010 under 35 U.S.C. §119; the entire contents of all are hereby incorporated by reference.

TECHNICAL FIELD

The present invention relates to a phase controller which is suitably used for a device serving to convert light having a high energy such as a soft X-ray from linearly polarized light to circularly polarized light, for example.

BACKGROUND ART

Conventionally, there is provided a device for converting light from linearly polarized light to circularly polarized light. For example, a simple structure such as a transmission type polarizing plate or polarizing film is used for converting visible light or infrared light into circularly polarized light. Moreover, there is also provided an undulator for spirally meandering an electron beam to carry out a conversion into circularly polarized light by periodically applying a magnetic field in a horizontal or perpendicular direction with respect to an orbit of the electron beam (for example, see Patent Documents 1 and 2).

Patent Document 1: Japanese Laid-Open Patent Publication No. 7-288200

Patent Document 2: Japanese Laid-Open Patent Publication No. 9-219564

An X-ray is included as a kind of light. The X-ray is an electromagnetic wave having a wavelength of approximately 1 [pm] to several tens [nm] which includes a hard X-ray and a soft X-ray. The hard X-ray is an X-ray having a high energy and a great transmission to a substance and is used for taking an X-ray photograph, for example. On the other hand, the soft X-ray is an X-ray having a lower energy than the hard X-ray, a high absorption into a substance and a small transmission. The soft X-ray converted into circularly polarized light is regarded to be easily absorbed into a substance because of a small transmission and to enable a detection of an electronic spin state in the substance, and therefore, is expected as effective means for an intravital test or a genetic analysis.

DISCLOSURE OF THE INVENTION

In the case in which a soft X-ray is utilized for an intravital test, a genetic analysis or the like, it is required to be circularly polarized light. The circularly polarized light has a difference in an electronic spin state, for example, a difference between a counterclockwise direction and a clockwise direction, a difference between a parallelism and an antiparallelism, or the like. Therefore, the difference can be applied to an analysis of a nanomaterial. Since the soft X-ray basically appears as linearly polarized light (a superposition of two states of circularly polarized counterclockwise light and circularly polarized clockwise light), it is to be converted into circularly polarized light.

However, the soft X-ray has a lower energy than the hard X ray and still has a high energy of 10 [eV] or more. In a region having a high energy of the soft X-ray which exceeds 10 [eV], a simple structure such as a polarizing plate cannot be used for converting the linearly polarized light into the circularly polarized light. For this reason, there is conventionally employed a method using an undulator for converting linearly polarized light of an electron beam into circularly polarized light. However, this method has a problem in that large-scale facilities referred to as a so-called synchrotron (synchronous circular accelerator) or linac (linear accelerator) are required.

The synchrotron or linac serves to carry out a conversion into circularly polarized light in a principle for applying a cyclic magnetic field to periodically bend an electron beam when the electron beam passes through the undulator. The accelerated electron beam does not easily react to the magnetic field. For this reason, an electron orbit is to be meandered little by little by a very long magnetic array. In order to bend the orbit of the electron beam, moreover, a large magnetic field is required and a large-scale superconductive magnet or the like is to be used. In order to minimize an energy loss of the accelerated electron beam, furthermore, it is necessary to bring a vacuum state. Since the electron beam is to run by a long distance, however, large-scale facilities for bringing an ultrahigh vacuum state are required. For this reason, the synchrotron or the linac is to be large-scaled by mans of a small-scale device.

The present invention has been made to solve the problem and has an object to phase control linearly polarized light of a soft X-ray, thereby enabling a conversion into circularly polarized light by means of a small-scale device.

In order to solve the problem, in the present invention, a reflection surface constituted by a transition metal having a core level absorption edge in the vicinity of a wavelength of a soft X-ray is formed on an inside of a vacuum vessel, and furthermore, there is provided a magnet for generating a magnetic field in a perpendicular direction to a longitudinal direction of the vacuum vessel in a position of the reflection surface by which the soft X-ray is to be reflected. The soft X-ray incident on the vacuum vessel is reflected at least once over the reflection surface in the position where the magnetic field is applied so that the soft X-ray having a phase controlled is emitted from the vacuum vessel.

According to the present invention constituted as described above, the soft X-ray has an energy in a wavelength which is close to the core level absorption edge of the transition metal forming the reflection surface. When the soft X-ray incident on the vacuum vessel is to be reflected by the reflection surface, therefore, magnetic scattering caused by the magnetic field applied in the position of the reflection surface is increased by a resonant effect of a magnetic circular dichroism. In other words, although a difference is made in a refractive index between circularly polarized counterclockwise light and circularly polarized clockwise light in the core level absorption edge causing the magnetic scattering, the difference in the refractive index leads to a phase difference between the circularly polarized counterclockwise light and the circularly polarized clockwise light. By varying the number of the reflection surfaces, a strength of the magnetic field or an angle of incidence, it is possible to control the phase difference. Moreover, the difference in the refractive index is increased by the resonant effect of the magnetic circular dichroism. Therefore, it is possible to obtain, at a time, the phase difference between the circularly polarized counterclockwise light and the circularly polarized clockwise light which constitute the linearly polarized light through a superposition. Consequently, it is possible to convert the linearly polarized light of the soft X-ray into the circularly polarized light by the reflection to be carried out at a few times.

The linearly polarized light can be converted into the circularly polarized light at a small number of times of the reflection. Therefore, it is not necessary to lengthen the vacuum vessel and the magnetic array. Consequently, it is not necessary to employ large-scale facilities for bringing an ultrahigh vacuum state, and it is sufficient that the simple vacuum pump is used. Moreover, the magnetic scattering is increased by the resonant effect of the magnetic circular dichroism. Therefore, it is not necessary to use a large-scale superconductive magnet or the like, and it is sufficient that a small permanent magnet is provided. Accordingly, a size of the device for converting the linearly polarized light of the soft X-ray into the circularly polarized light can be reduced remarkably as compared with a synchrotron or the like.

BEST MODE FOR CARRYING OUT THE INVENTION

First Embodiment

Figure 1:
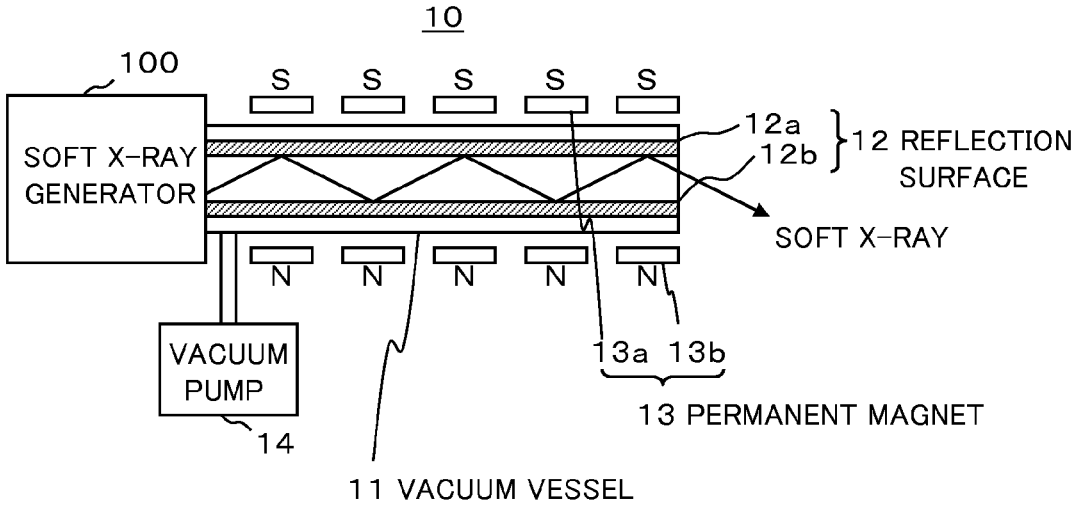
FIG. 1 is a view showing an example of a structure of a circularly polarized light converter according to a first embodiment.
Figure 2:
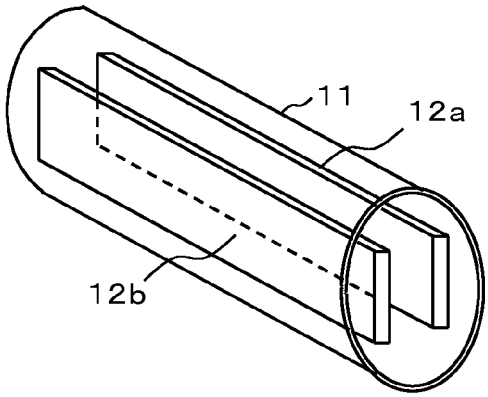
FIG. 2 is a view showing an example of an arrangement of a reflection surface according to the first embodiment.
Figure 3:
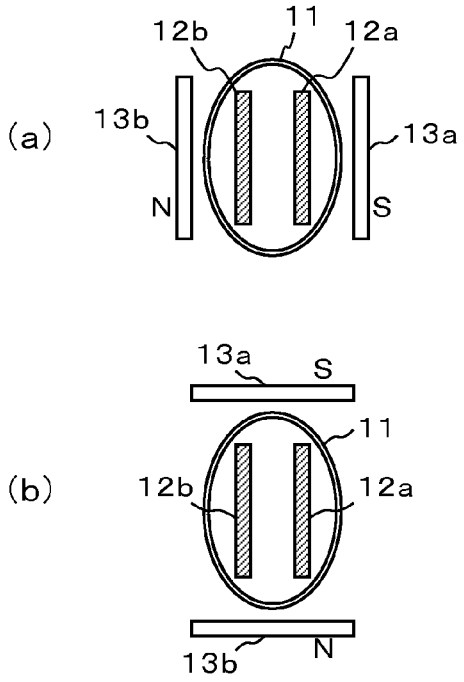
FIG. 3 is a view showing an example of an arrangement of a permanent magnet according to the first embodiment.

An embodiment of a phase controller according to the present invention will be described below with reference to the drawings. FIG. 1 is a view showing an example of a structure of a circularly polarized light converter carrying out a phase controller according to a first embodiment. FIG. 2 is a view showing an example of an arrangement of a reflection surface according to the first embodiment. FIG. 3 is a view showing an example of an arrangement of a permanent magnet according to the first embodiment.

As shown in FIG. 1, a circularly polarized light converter 10 according to the first embodiment includes a hollow vacuum vessel 11 serving as a route for a soft X-ray which is emitted from a soft X-ray generator 100, a reflection surface 12 formed on an inside of the vacuum vessel 11, a permanent magnet 13 for generating a magnetic field, and a vacuum pump 14 for bringing a vacuum state in the vacuum vessel 11.

As shown in FIG. 2, for example, the vacuum vessel 11 is an elliptically cylindrical vessel having an elliptical section and is constituted by glass or the like. A housing of the vacuum vessel 11 has a diameter of approximately 10 to 50 [mm], for example. Moreover, the housing has a length of approximately 10 to 50 [cm], for example.

The reflection surface 12 includes a pair of reflection plates 12*a* and 12*b* formed in a longitudinal direction of the vacuum vessel 11, for example. The pair of reflection plates 12*a* and 12*b* are disposed to be perpendicularly opposed to each other in parallel with an average advancing direction of the soft X-ray (the longitudinal direction of the vacuum vessel 11). A void distance between the reflection plates 12*a* and 12*b* is approximately 1 to several [mm], for example. Moreover, full lengths of the reflection plates 12*a* and 12*b* are approximately 10 to 50 [cm], for example.

The refection surface 12 is constituted by a transition metal having a core level absorption edge in the vicinity of a wavelength of a soft X-ray which is incident on the vacuum vessel 11. For example, the reflection surface 12 is constituted, as a transition metal having a 3*p*-3*d* core level absorption edge in the vicinity of the wavelength of the soft X-ray, by tungsten (W) if the wavelength of the soft X-ray is 2.8 [nm], cobalt (Co) if the wavelength of the soft X-ray is 19.8 [nm], nickel (Ni) if the wavelength of the soft X-ray is 17.9 [nm], manganese (Mn) if the wavelength of the soft X-ray is 24.3 [nm], titanium (Ti) if the wavelength of the soft X-ray is 25.8 [nm], a perovskite type 3*d* transition metal oxide (Y1-xCaxTiO3) if the wavelength of the soft X-ray is 26.9 [nm], and a ferrous superconductor (LaFeAsO) if the wavelength of the soft X-ray is 22.9 [nm].

The permanent magnet 13 serves to generate a magnetic field in a perpendicular direction to the longitudinal direction of the vacuum vessel 11 in a position where the soft X-ray is reflected by the reflection surface 12. A strength of a magnetism of the permanent magnet 13 is approximately 0.2 to 1 [T], for example. The permanent magnet 13 is constituted to include plural sets of magnet pairs 13*a* and 13*b* which are disposed to interpose the vacuum vessel 11 therebetween at an outside of the vacuum vessel 11. The pair of magnets 13*a* and 13*b* are disposed in such a manner that north and south poles are opposed to each other. Moreover, the plural sets of magnets 13*a* and 13*b* are disposed at an equal interval in the longitudinal direction of the vacuum vessel 11. Positions placed at the equal interval correspond to positions in which the soft X-ray is reflected by the reflection surface 12.

It is sufficient that the permanent magnet 13 generates a magnetic field in a perpendicular direction to the longitudinal direction of the vacuum vessel 11 and whether the magnetic field is perpendicular to the reflection surface 12 does not matter. In other words, the permanent magnet 13 may be disposed in parallel with the reflection surface 12 as shown in FIG. 3(*a*) and the permanent magnet 13 may be disposed perpendicularly to the reflection surface 12 as shown in FIG. 3(*b*).

In general, in the case in which an energy of an X-ray is close to a core level absorption edge of a magnetic atom, magnetic scattering is increased to be several times to $10^5$ times as large as ordinary magnetic scattering by a resonant effect. According to the present embodiment, in order to utilize the resonant effect of a magnetic circular dichroism, the reflection surface 12 is constituted by a transition metal having a 3*p*-3*d* core level absorption edge in the vicinity of the wavelength of the soft X-ray and a magnetic field is thus applied to the reflection surface 12 by means of the permanent magnet 13. The soft X-ray to be linearly polarized light is incident in the vacuum vessel 11 set into the vacuum state by means of the vacuum pump 14 and is reflected at plural times over the reflection surface 12 in a position where the magnetic field is applied.

According to the first embodiment thus constituted, when the soft X-ray incident on the vacuum vessel 11 is reflected by the reflection surface 12, the magnetic scattering is increased by the resonant effect of the magnetic circular dichroism. Therefore, a great difference is made in a refractive index between the circularly polarized counterclockwise light and the circularly polarized clockwise light which constitute the linearly polarized light of the soft X-ray, and a phase difference can be made between the circularly polarized counterclockwise light and the circularly polarized clockwise light at a time. Consequently, it is possible to convert the linearly polarized light of the soft X-ray into the circularly polarized light by carrying out the reflection at only several times and to then emit, from the vacuum vessel 11, the soft X-ray converted into the circularly polarized light. According to the present embodiment, moreover, it is possible to act on the soft X-ray itself which is generated in the soft X-ray generator 100, thereby converting the linearly polarized light into the circularly polarized light. To the contrary, it is also possible to reversibly return the circularly polarized light into the linearly polarized light. Although the conventional method using an electron beam can make a circularly polarized light component artificially, it cannot act on the soft X-ray itself at all.

Thus, the linearly polarized light of the soft X-ray can be converted into the circularly polarized light at a small number of times of the reflection. Therefore, it is not necessary to lengthen the vacuum vessel 11 in the longitudinal direction. Consequently, it is not necessary to employ large-scale facilities for bringing an ultrahigh vacuum state, and it is sufficient that the simple vacuum pump 14 is used. Moreover, the magnetic scattering is increased by the resonant effect of the magnetic circular dichroism. Therefore, it is not necessary to use a large-scale superconductive magnet or the like, and it is sufficient that a few small permanent magnets 13 are used. Accordingly, a size of the device for converting the linearly polarized light of the soft X-ray into the circularly polarized light can be reduced remarkably as compared with a synchrotron or the like.

Second Embodiment

Figure 4:
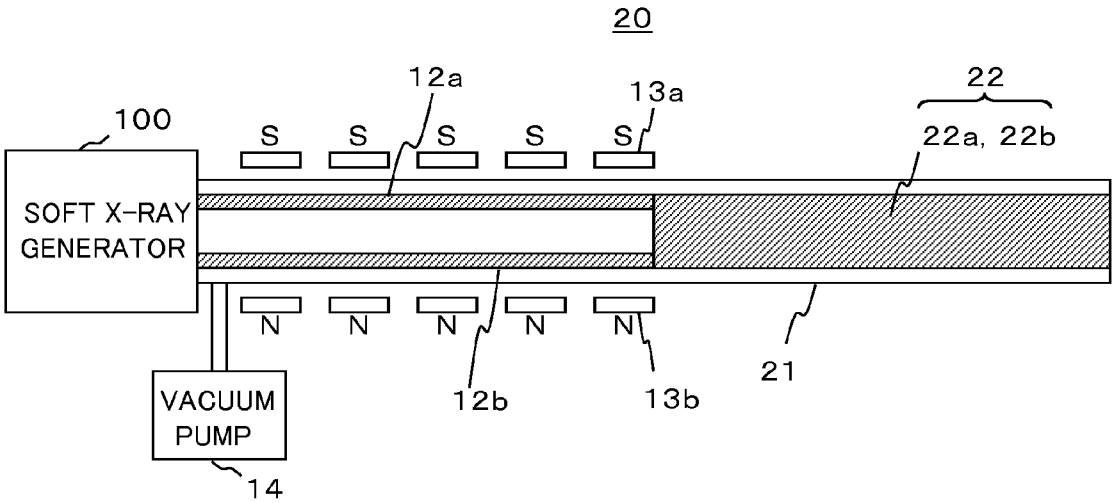
FIG. 4 is a view showing an example of a structure of a circularly polarized light converter according to a second embodiment.

Next, a second embodiment according to the present invention will be described with reference to the drawings. FIG. 4 is a view showing an example of a structure of a circularly polarized light converter carrying out a phase controller according to the second embodiment. In FIG. 4, components having the same reference numerals as those shown in FIG. 1 have the same functions and repetitive description will be omitted.

As shown in FIG. 4, a circularly polarized light converter 20 according to the second embodiment includes a second reflection surface 22 in addition to the structure illustrated in FIG. 1. Moreover, a vacuum vessel 21 has a double length in the longitudinal direction as compared with the vacuum vessel 11 shown in FIG. 1.

The second reflection surface 22 is disposed in a subsequent part to a reflection surface 12 at an inside of the vacuum vessel 21. A length of the second reflection surface 22 is equal to that of the reflection surface 12. In the same manner as the reflection surface 12, the second reflection surface 22 is also constituted by a pair of reflection plates 22*a* and 22*b* formed in a longitudinal direction of the vacuum vessel 21. The pair of reflection plates 22*a* and 22*b* are disposed to be perpendicularly opposed to each other in parallel with an average advancing direction of a soft X-ray (the longitudinal direction of the vacuum vessel 21). Moreover, the pair of reflection plates 22*a* and 22*b* are disposed in a perpendicular direction to a pair of reflection plates 12*a* and 12*b*.

The second reflection surface 22 is formed by the same transition metal as the reflection surface 11. In other words, the second reflection surface 22 is also formed of tungsten (W) if the reflection surface 12 is formed of the tungsten (W), and the second reflection surface 22 is also formed of cobalt (Co) if the reflection surface 12 is formed of the cobalt (Co).

In the second embodiment, a soft X-ray to be linearly polarized light is incident in the vacuum vessel 21 set into a vacuum state by means of a vacuum pump 14 and is reflected at plural times over the reflection surface 12 in a position where a magnetic field is applied by a permanent magnet 13, and then, the soft X-ray is further reflected at plural times over the second reflection surface 22. The number of times of the reflection over the reflection surface 12 is set to be equal to that of the reflection over the second reflection surface 22.

In a polarizing state of the soft X-ray to be reflected by the reflection surface 12, a polarizing direction of the soft X-ray to be incident is represented as a sum of vectors of light (s polarized light) which is polarized in parallel with the reflection surface 12 and light (p polarized light) which is polarized perpendicularly to the reflection surface 12. However, a reflectance on the reflection surface 12 is varied between the s polarized light and the p polarized light. For this reason, an intensity of the s polarized light is different from that of the p polarized light. If phases of circularly polarized clockwise light and circularly polarized counterclockwise light are simply controlled, therefore, the soft X-ray is converted into elliptically polarized light which is not completely circularly polarized light.

Therefore, the phase of the soft X-ray is controlled by the reflection at plural times over the reflection surface 12 to which a magnetic field is applied, and the reflection at equal times to that for the reflection surface 12 is then caused over the second reflection surface 22 to which the magnetic field is not applied. At this time, the s polarized light over the reflection surface 12 is set into the p polarized light over the second reflection surface 22 and the p polarized light over the reflection surface 12 is set into the s polarized light over the second reflection surface 22 so that the reflectances can be reversed and an intensity of the s polarized light and that of the p polarized light can be finally set to be equal to each other by the reflection at equal times to that for the reflection surface 12, since the second reflection surface 22 is disposed in a perpendicular direction to the reflection surface 12. Consequently, the soft X-ray converted into completely circularly polarized light can be emitted from the vacuum vessel 21.

Although the description has been given to the example in which the transition metal having the 3*p*-3*d* core level absorption edge in the vicinity of the wavelength of the soft X-ray incident on the vacuum vessels 11 and 21 is used as the transition metal constituting the reflection surface 12 and the second reflection surface 22 in the first and second embodiments, the present invention is not restricted thereto. In other words, the 3*p*-3*d* based transition metal does not need to be utilized if there is used any transition metal having the core level absorption edge in the vicinity of the wavelength of the soft X-ray. For example, if the wavelength of the soft X-ray is 6.2 [nm], the reflection surface 12 and the second reflection surface 22 may be constituted by tungsten (W) having a 4*s*-4*p* core level absorption edge.

Although the description has been given to the example in which the reflection surface 12 is constituted by the pair of reflection plates 12*a* and 12*b* and the second reflection surface 22 is constituted by the pair of reflection plates 22*a* and 22*b* in the first and second embodiments, moreover, the present invention is not restricted thereto. For example, a reflection sheet formed by a transition metal may be stuck onto inner surfaces of the vacuum vessels 11 and 21 or the transition metal may be deposited on the inner surfaces of the vacuum vessels 11 and 21.

Although the description has been given to the example in which the light of the soft X-ray is converted from the linearly polarized light into the circularly polarized light in the embodiments, furthermore, the present invention is not restricted thereto. For example, by utilizing the same principle, it is also possible to convert the light of the soft X-ray from the circularly polarized light into the linearly polarized light.

In addition, both of the first and second embodiments are only illustrative for materialization to carry out the present invention and the technical scope of the present invention should not be thereby construed to be restrictive. In other words, the present invention can be carried out in various forms without departing from the spirit or main features thereof.

INDUSTRIAL APPLICABILITY

The phase controller according to the present invention is suitably used for a device which serves to convert light having a high energy such as a soft X-ray from linearly polarized light into circularly polarized light. Moreover, the phase controller according to the present invention can also be used for a device which serves to convert light having a high energy such as a soft X-ray from circularly polarized light into linearly polarized light.

The invention claimed is:

1. A phase controller comprising:

a hollow vacuum vessel to be a route for a soft X-ray;

a reflection surface formed on an inside of the vacuum vessel and constituted by a transition metal having a core level absorption edge in the vicinity of a wavelength of the soft X-ray;

a magnet for generating a magnetic field in a perpendicular direction to a longitudinal direction of the vacuum vessel in a position where the soft X-ray is to be reflected by the reflection surface; and a vacuum pump for bringing a vacuum state in the vacuum vessel, wherein the soft X-ray to be linearly polarized light is incident in the vacuum vessel set into the vacuum state by means of the vacuum pump and is reflected at least once over the reflection surface in a position where the magnetic field is applied so that the soft X-ray having a phase controlled is emitted from the vacuum vessel.

2. The phase controller according to claim 1, wherein the soft X-ray to be the linearly polarized light is incident in the vacuum vessel set into the vacuum state by means of the vacuum pump and is reflected at plural times over the reflection surface in the position where the magnetic field is applied so that the soft X-ray converted into circularly polarized light is emitted from the vacuum vessel.

3. The phase controller according to claim 2, further comprising a second reflection surface which is formed in a perpendicular direction to the reflection surface in a subsequent part to the reflection surface at an inside of the vacuum vessel, and is constituted by the same transition metal as the reflection surface, the soft X-ray to be the linearly polarized light being incident in the vacuum vessel set into the vacuum state by means of the vacuum pump and being reflected at plural times over the reflection surface in the position where the magnetic field is applied, and the soft X-ray being then reflected at plural times over the second reflection surface so that the soft X-ray converted into the circularly polarized light is emitted from the vacuum vessel.

4. The phase controller according to claim 3, wherein the reflection surface and the second reflection surface are formed to have an equal length, and a number of times of reflection over the reflection surface is equal to a number of times of reflection over the second reflection surface.

* * * * *